US010512347B1

(12) United States Patent
Shepard et al.

(10) Patent No.: US 10,512,347 B1
(45) Date of Patent: Dec. 24, 2019

(54) DUAL-DISPENSING LID

(71) Applicant: Zak Designs, Inc., Spokane, WA (US)

(72) Inventors: Seth Shepard, Spokane, WA (US); Andrew Gillespie, South Easton, MA (US)

(73) Assignee: Zak Designs, Inc., Spokane, WA (US)

( * ) Notice: Subject to any disclaimer, the term of this patent is extended or adjusted under 35 U.S.C. 154(b) by 0 days.

(21) Appl. No.: 16/115,307

(22) Filed: Aug. 28, 2018

(51) Int. Cl.

| | |
|---|---|
| ***A47G 19/22*** | (2006.01) |
| ***B65D 47/14*** | (2006.01) |
| ***B65D 47/32*** | (2006.01) |
| ***B65D 47/12*** | (2006.01) |
| ***B65D 47/06*** | (2006.01) |

(52) U.S. Cl.
CPC ..... *A47G 19/2272* (2013.01); *B65D 47/066* (2013.01); *B65D 47/122* (2013.01); *B65D 47/148* (2013.01); *B65D 47/32* (2013.01); *B65D 2543/00046* (2013.01); *B65D 2543/00074* (2013.01); *B65D 2543/00231* (2013.01)

(58) Field of Classification Search
CPC ..... A47G 19/2272; B65D 47/122; B65D 47/148; B65D 47/32
USPC ..... 222/478
See application file for complete search history.

(56) References Cited

U.S. PATENT DOCUMENTS

| | | | | |
|---|---|---|---|---|
| 2,447,870 | A * | 8/1948 | Polcyn | A47G 19/2272 215/309 |
| 5,203,468 | A * | 4/1993 | Hsu | A47G 19/2272 220/254.3 |
| 5,346,081 | A * | 9/1994 | Lin | B65D 47/066 215/229 |
| 5,456,380 | A * | 10/1995 | Ito | A47G 19/2272 220/713 |
| 6,763,964 | B1 * | 7/2004 | Hurlbut | A47G 19/2272 220/254.2 |
| 8,550,269 | B2 * | 10/2013 | Lane | B65D 47/066 215/229 |
| 8,573,431 | B2 * | 11/2013 | Shepard | A47G 19/2272 215/315 |
| 8,777,044 | B1 * | 7/2014 | Raymus | A47G 19/2272 215/12.1 |
| 9,220,360 | B2 * | 12/2015 | Arai | A47G 19/2266 |
| 9,272,822 | B2 * | 3/2016 | Samartgis | B65D 47/12 |
| 9,380,898 | B2 * | 7/2016 | Mason | A47G 19/2272 |
| 9,771,189 | B2 * | 9/2017 | Miksovsky | B65D 47/122 |
| 9,790,007 | B2 * | 10/2017 | Sorensen | A47G 19/00 |
| 9,901,199 | B2 * | 2/2018 | Maple | A47G 19/2272 |
| 10,059,491 | B2 * | 8/2018 | Wong | B65D 43/0225 |
| 10,117,533 | B2 * | 11/2018 | Chen | A47G 19/2272 |
| 10,124,937 | B2 * | 11/2018 | Wiesman | A47G 19/2272 |
| 10,159,368 | B2 * | 12/2018 | Lin | A47G 19/2272 |

(Continued)

*Primary Examiner* — Patrick M. Buechner
*Assistant Examiner* — Michael J. Melaragno
(74) *Attorney, Agent, or Firm* — Randall Danskin P.S.

(57) ABSTRACT

A dual-dispensing lid includes a pour orifice, a pour spout corresponding with the pour orifice, and a pour cap selectively detachable from direct contact with the pour spout. The pour cap seals the pour spout from fluid exiting the fluid container through the pour spout. The lid also includes a sip orifice and an elongated and resilient sip spout inserted through the sip orifice. A sip cap is selectively releasable from compression against the sip spout and selectively compressible against the sip spout in a manner that seals the sip spout from fluid exiting the fluid container through the sip spout.

23 Claims, 12 Drawing Sheets

(56) References Cited

U.S. PATENT DOCUMENTS 10,165,879 B2 * 1/2019 Davies ..... A47G 19/2266
2003/0168455 A1 * 9/2003 Zettle ..... B65D 47/0895 220/254.3
2012/0228315 A1 * 9/2012 Davies ..... A47G 19/2266 220/715
2012/0305559 A1 * 12/2012 Steininger ..... B65D 47/065 220/253
2012/0312832 A1 * 12/2012 Lane ..... B65D 47/066 220/833
2012/0325815 A1 * 12/2012 Gilbert ..... A47G 19/2272 220/264
2014/0048549 A1 * 2/2014 Wille ..... B65D 43/0222 220/713
2014/0326731 A1 * 11/2014 Raymus ..... A47G 19/2272 220/524
2014/0353323 A1 * 12/2014 Joy ..... A47G 19/2266 220/708
2015/0173539 A1 * 6/2015 Mason ..... A47G 19/2272 220/707
2015/0201773 A1 * 7/2015 Sorensen ..... A47J 43/27 220/254.5
2015/0201776 A1 * 7/2015 Elsaden ..... A47G 19/2272 220/715
2015/0282654 A1 * 10/2015 Kurabe ..... A47G 19/2272 220/254.5
2016/0207672 A1 * 7/2016 Wong ..... B65D 43/0225
2016/0213178 A1 * 7/2016 Maple ..... A47G 19/2272
2016/0332784 A1 * 11/2016 Lu ..... B65D 47/0871
2017/0105581 A1 * 4/2017 Enghard ..... A47J 43/27
2017/0112310 A1 * 4/2017 Davies ..... A47G 19/2266
2017/0144809 A1 * 5/2017 Sorensen ..... A47G 19/00
2017/0208974 A1 * 7/2017 Zhang ..... A47G 19/2272
2017/0238744 A1 * 8/2017 Sweeney ..... A47G 19/2227
2017/0240321 A1 * 8/2017 Sims ..... A47G 19/2272
2017/0267423 A1 * 9/2017 Maruyama ..... A47G 19/2272
2017/0283132 A1 * 10/2017 Sorensen ..... A47G 19/00
2017/0297785 A1 * 10/2017 Maruyama ..... A47G 19/2272
2017/0313479 A1 * 11/2017 Li ..... A47G 19/2272
2018/0070751 A1 * 3/2018 Davies ..... A47G 19/2266
2018/0168377 A1 * 6/2018 Sorensen ..... A47G 19/2266

* cited by examiner

DUAL-DISPENSING LID

BACKGROUND

Those skilled in the art will recognize that various liquid dispensing containers and related covers or lids have been fabricated and sold over many decades. For many years, these liquid dispensing containers, and their associated covers or lids, have been designed to meet the particular needs of the users during their various activities. For example, liquid dispensing containers have been specifically designed for assorted events/activities such as running, bicycle riding, hiking, rock climbing, driving an automobile, attendance at sporting events, and the like. Much attention has been directed in these prior art designs to providing a liquid dispensing vessel which permits a user to consume or dispense liquid from the container in a reliable manner during the activity, and which further reduces accidental spilling of the liquid from the container in the event that the drinking vessel is accidentally overturned.

With regard to drinking containers which are often going to be utilized during an athletic event, much attention has been directed towards developing beverage containers which can be operated by a single hand, and which further simultaneously allows for the equalization of air pressure within the internal cavity of the drinking vessel as the beverage contained within the vessel is consumed.

While many possible designs have been developed to address these assorted needs, several shortcomings have become apparent after prolonged usage of these same prior art products.

For example, many users of these prior art drinking vessels often need to consume the contents of the drinking vessel quickly while engaged in various athletic pursuits. Moreover, many athletes often need to receive large volumes of the fluid to be dispensed in view of the vigorous athletic activity that they are pursuing. The prior art liquid dispensing containers have not, generally speaking, been designed to rapidly deliver large volumes of fluid, or other liquid from the dispensing container, in view of the concern that such liquid, in large volumes, would cause problems in the event that the drinking vessel was accidentally overturned. Consequently, smaller volumes of liquid are often dispensed from most fluid dispensing containers. Accordingly, drinking vessels with greater versatility would be beneficial.

Moreover, the complexity of the various designs of the prior art drinking vessels have often impaired the ability of the same drinking vessel to dispense substantially all the contents of the fluid dispensing container. Those skilled in the art will recognize that often a small volume of fluid remains within the fluid dispensing vessel notwithstanding that the user has attempted to drain the entire contents of the same liquid dispensing vessel. Accordingly, drinking vessels that drain the entire contents would be beneficial.

In view of the complexity of the prior art devices and other drinking vessels employed, to date, problems often arise regarding how to effectively cleanse such drinking vessels, or fluid dispensing containers, in view of the likelihood that sticky residue or other contamination from the fluid contained within the drinking vessel coats the drinking vessel, or associated lid or cover, and thereby makes them either wholly or partially inoperative or undesirable. This trace residue often encourages the growth of microorganisms and further inhibit the proper operation of any sealing device or other dispensing assembly employed to selectively dispense the liquid or beverage from the fluid dispensing container. Accordingly, drinking vessels more easily cleaned would be beneficial.

BRIEF DESCRIPTION OF THE DRAWINGS

Some embodiments are described below with reference to the following accompanying drawings.

FIGS. 2 and 5 are top and bottom exploded views, respectively.

FIGS. 8 and 11 are top and bottom exploded views, respectively.

DETAILED DESCRIPTION

Multiple dual-dispensing lids are described herein for use with a fluid container. The combination of any one of the dual-dispensing lids herein with a fluid container provides drinking vessels with the beneficial characteristics discussed above in the Background section. Specifically, the dual-dispensing lids described herein may provide greater versatility by including both a pour spout for higher volume dispensing and a sip spout for lower volume dispensing. Also, the drinking vessels herein provide the ability to drain the entire contents of a drinking vessel. In addition, drinking vessels herein provide the benefit of being more easily cleaned.

Figure 1:
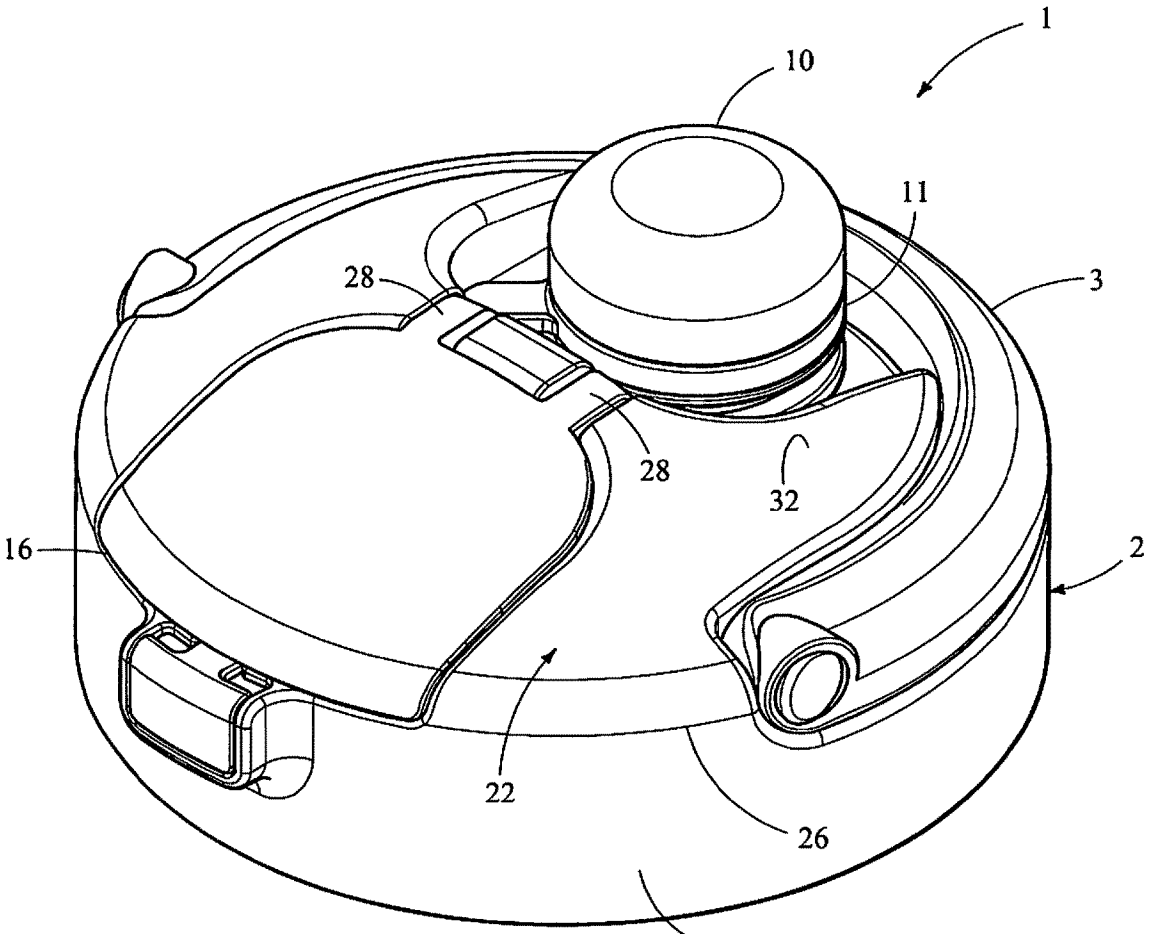
FIGS. 1-5 are isometric projections of a first dual-dispensing lid with top views (FIGS. 1-3) and bottom views (FIGS. 4 and 5).
Figure 2:
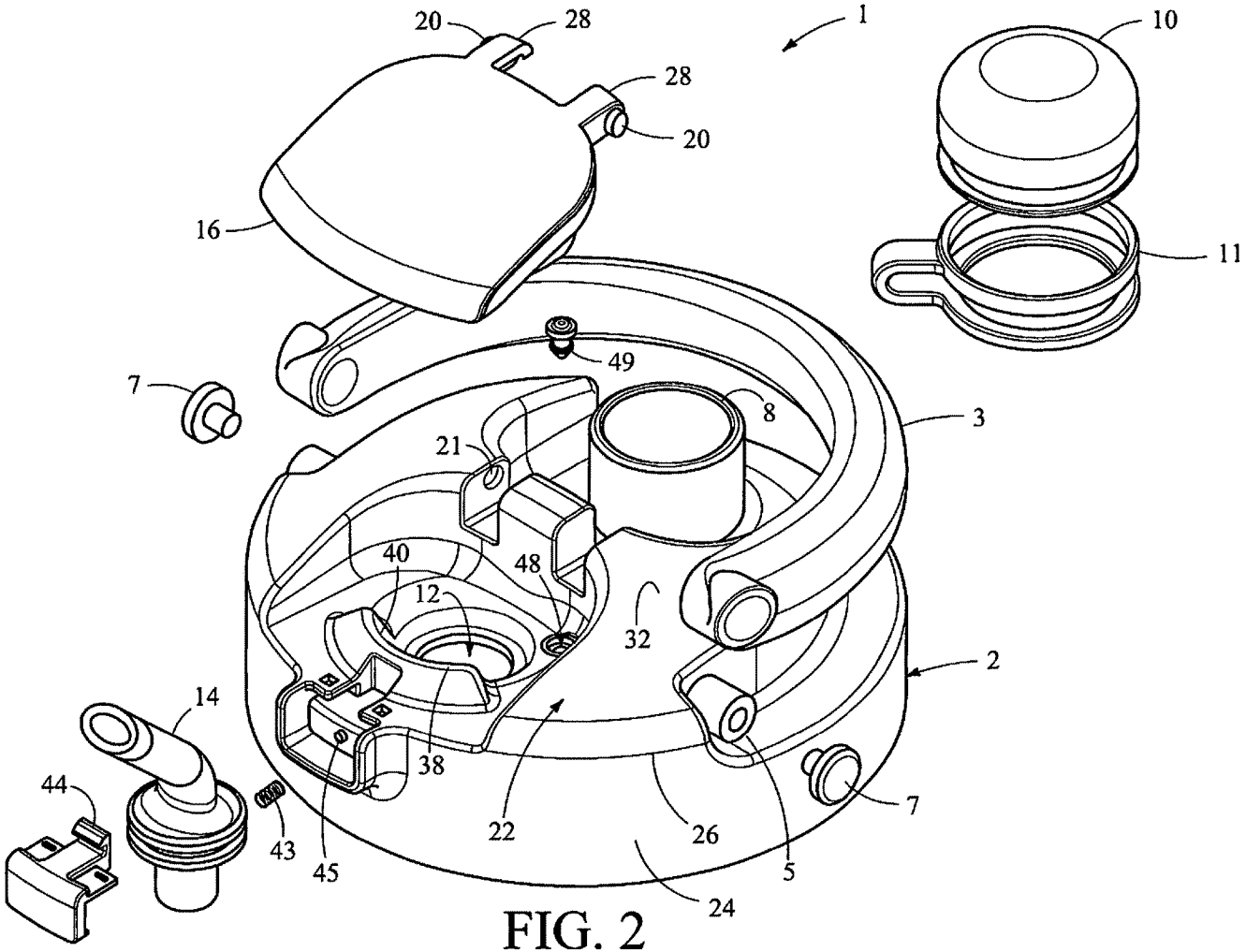
Figure 3:
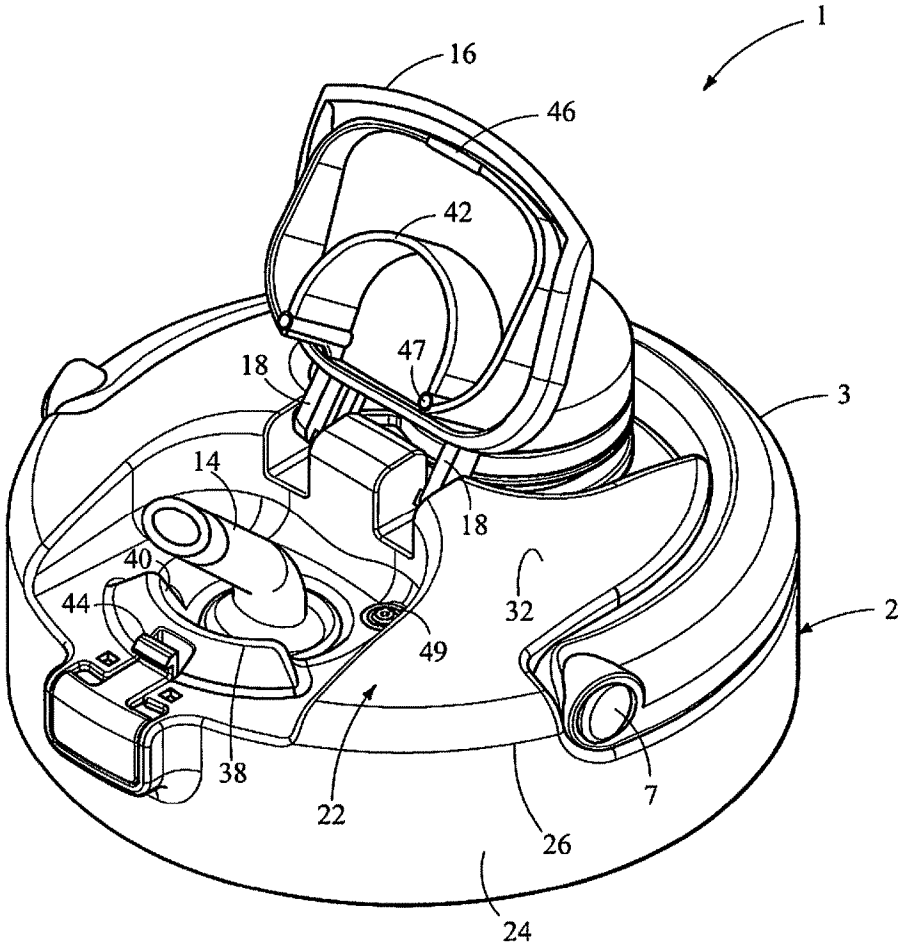
Figure 4:
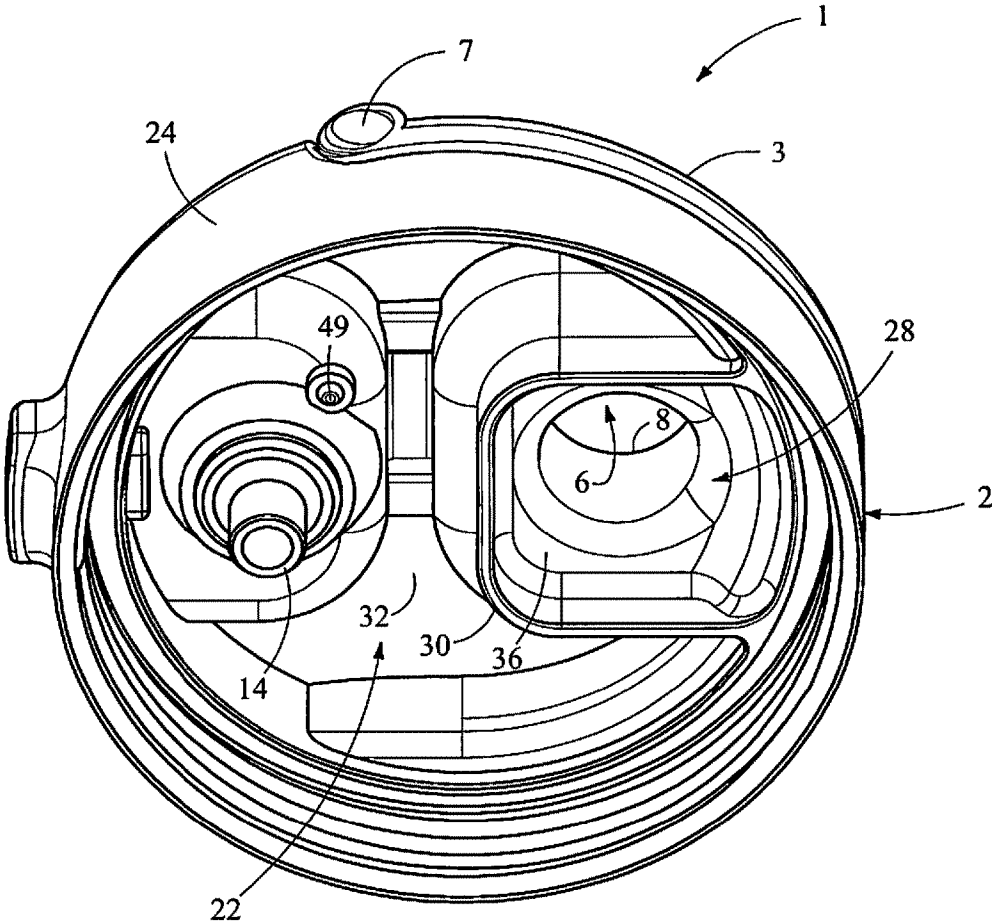
Figure 5:
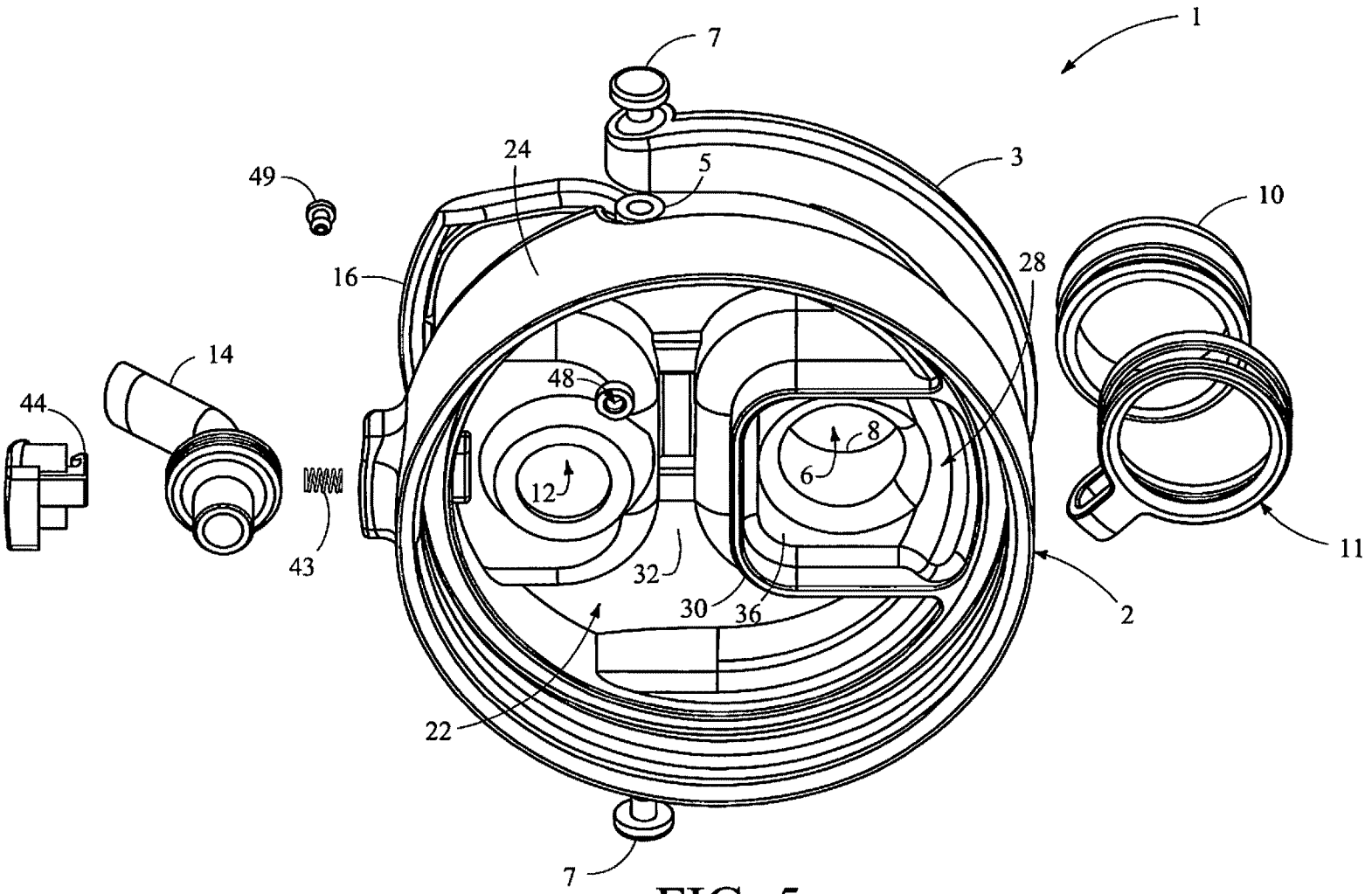
Figure 6:
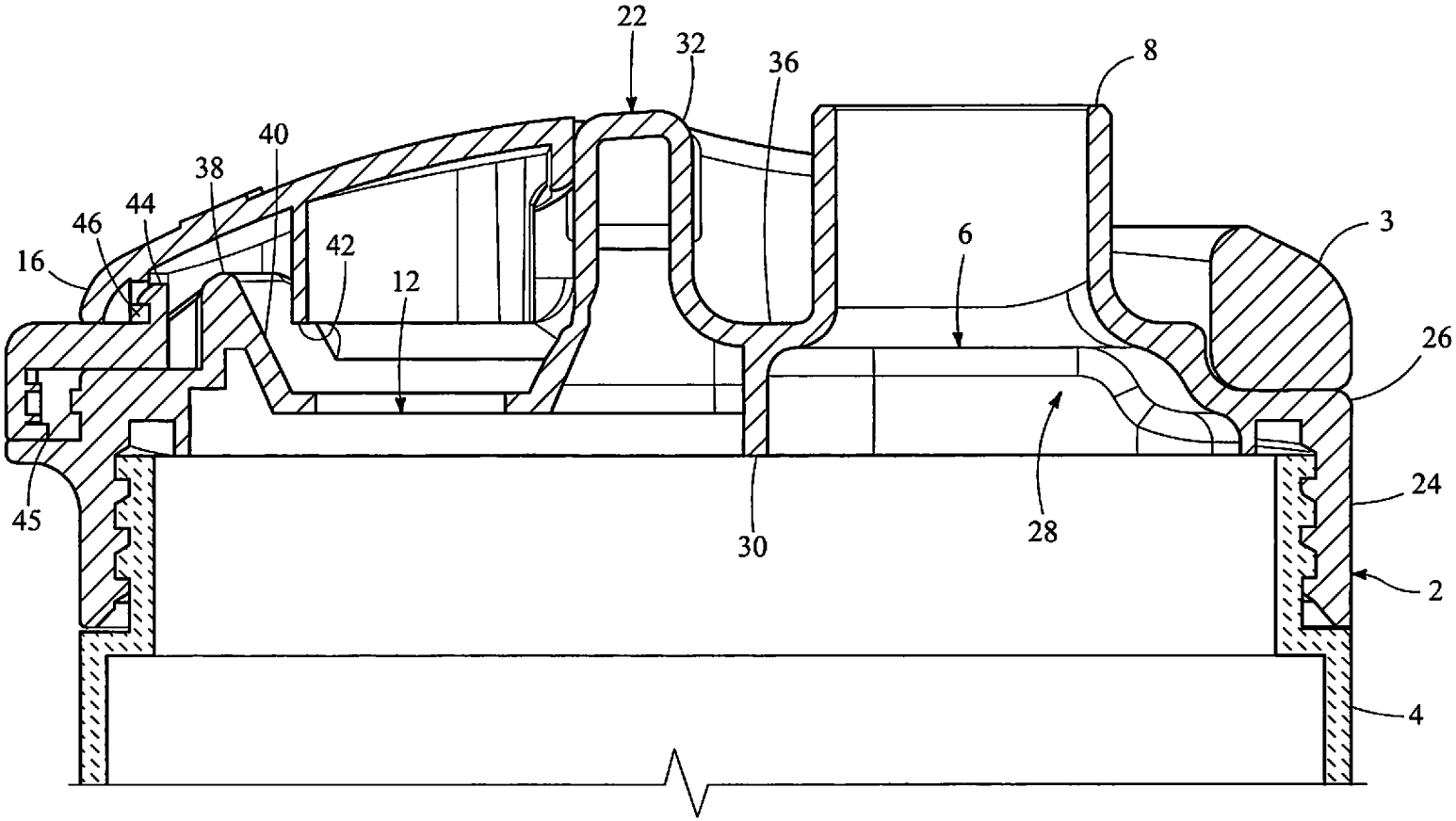
FIG. 6 is a cross-sectional view of the first dual-dispensing lid shown in FIGS. 1-5 engaged with a fluid container.
Figure 7:
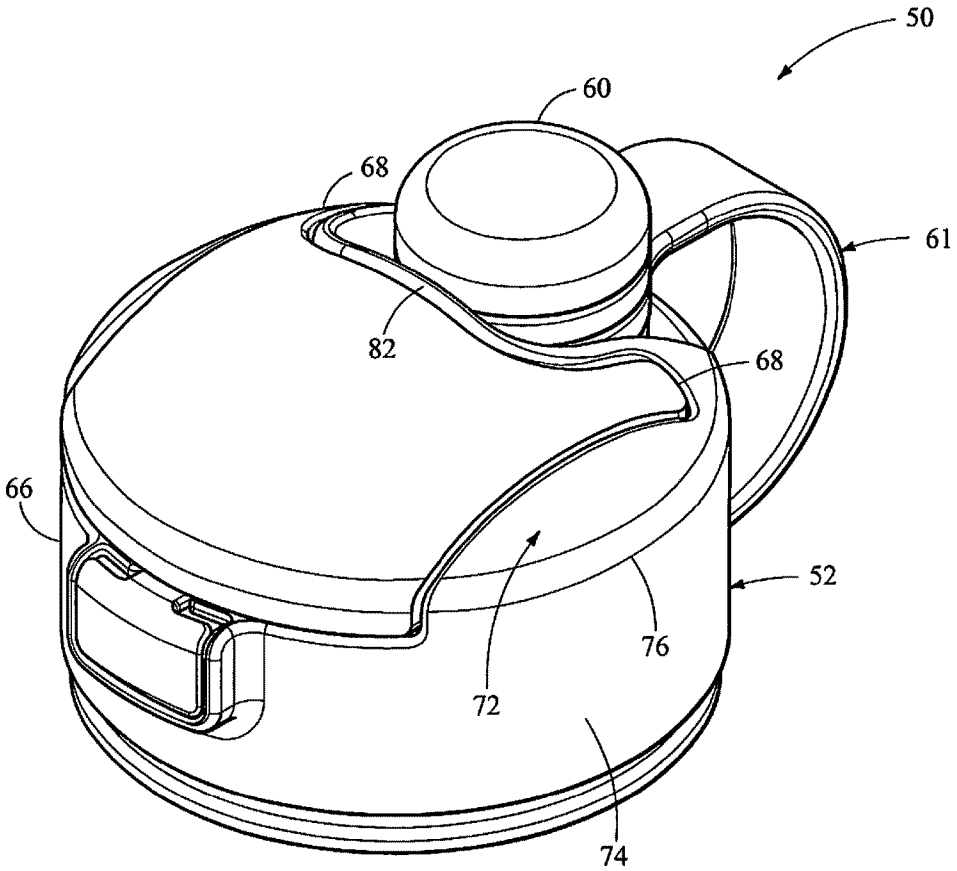
FIGS. 7-11 are isometric projections of a second dual-dispensing lid with top views (FIGS. 7-9) and bottom views (FIGS. 10 and 11).
Figure 8:
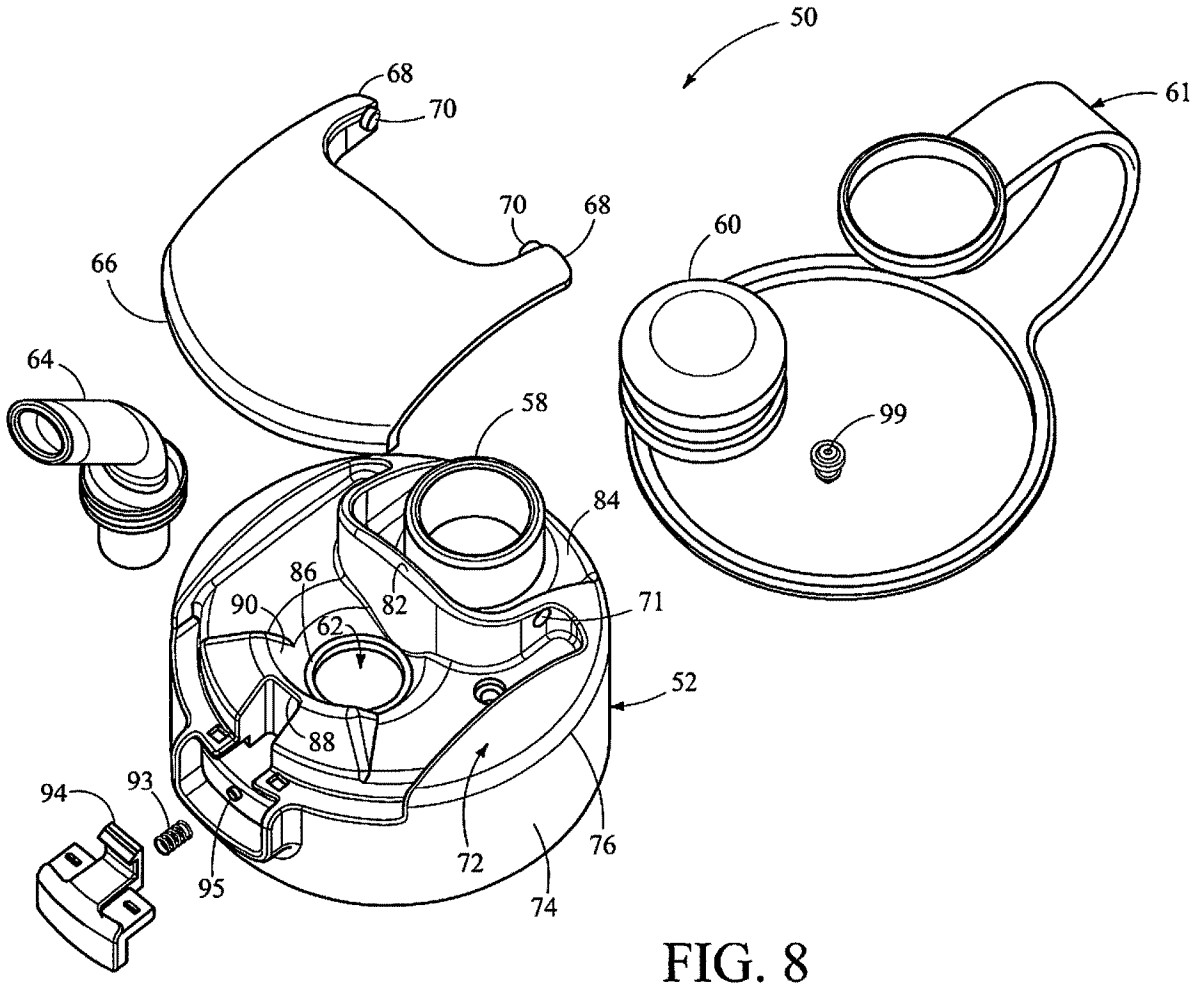

FIGS. 1-6 show a dual-dispensing lid 1 for use with a fluid container, such as fluid container 4 shown in FIG. 6. Fluid container 4 may have a wide variety of sizes and shapes and yet be operable in combination with dual-dispensing lid 1. Accordingly, the details of any particular fluid container 4 are not shown.

Dual-dispensing lid 1 includes a lid body 2 having a top wall 22 with a peripheral edge 26 and a circumscribing side wall 24 extending from peripheral edge 26. Lid body 2 is selectively detachable from fluid container 4 and configured to engage side wall 24 with fluid container 4 in sealing association. FIG. 6 shows a threaded connection between lid body 2 and fluid container 4, but other configurations for engagement are conceivable.

Dual-dispensing lid 1 includes a pour orifice 6 through top wall 22. A pour spout 8 corresponds with pour orifice 6 and extends outward from top wall 22. A pour cap 10 is selectively detachable from direct contact with pour spout 8 and it is configured to engage with pour spout 8 in a manner that seals pour spout 8 from fluid exiting fluid container 4 through pour spout 8. FIGS. 1-6 show a compression connection between pour cap 10 and pour spout 8, but other configurations for engagement, such as threaded connections, are conceivable. Pour spout 8 is shown as being circular in its lateral cross-section, however, other geometries are conceivable.

Dual-dispensing lid 1 further includes a sip orifice 12 through top wall 22. An elongated and resilient sip spout 14 is inserted through sip orifice 12. Sip spout 14 registers in sealing association with sip orifice 12 and extends outward from top wall 22. A sip cap 16 is selectively releasable from compression against sip spout 14. Sip cap 16 is also selectively compressible against sip spout 14 in a manner that seals sip spout 14 from fluid exiting fluid container 4 through sip spout 14.

Sip spout 14 (and sip spout 64 below) is elongated in the sense that it extends from top wall 22 (and top wall 72 discussed below) sufficiently to operate as a straw for a user to withdraw fluid by mouth from fluid container 4 (and fluid container 54 discussed below) while in an upright position. It will be understood by those of ordinary skill that withdrawing fluid by mouth with fluid container 4 and 54 in an upright position would utilize a straw, tube, or the like inserted into and extending from the interior portion of sip spout 14 and 64 to the fluid contents. Alternatively, in the absence of a straw, tube, or the like, fluid container 4 and 54 might be inverted to pour or otherwise expel fluid through sip spout 14 and 64. Even so, such operation would be less preferred when a vent is present, as discussed below for a vent plug 49 (and vent plug 99 discussed below), which may leak fluid upon inverting fluid container 4 and 54.

Sip spout 14 and 64 are resilient in the sense that they are flexible and yet return to the geometry shown after being bent or otherwise temporarily deformed. Of course, all materials exhibit limits in the extent to which they may be elastically deformed before plastic deformation occurs, permanently affecting the geometry. However, the material of sip spout 14 and 64 is selected at least to enable the sealing action implemented with sip cap 16 (and sip cap 66 discussed below) repeatedly over the lifetime of dual-dispensing lid 1 and 50.

Sip spout 14 is shown in FIGS. 1-6 having a size configured to pass a sipped volumetric flow rate of fluid exiting fluid container 4. Pour spout 8 is shown in FIGS. 1-6 having a size configured to pass a poured volumetric flow rate of fluid exiting fluid container 4. Given the size and configuration differences between sip spout 14 and pour spout 8 those of ordinary skill will appreciate that the poured volumetric flow rate is greater than the sipped volumetric flow rate.

The presence of spouts for dispensing fluid from a drinking vessel with two different flow rates increases the versatility of the drinking vessels described herein. Draining a drinking vessel quickly by "chugging" may be advantageous in certain circumstances, while users in other circumstances may prefer drinking more slowly by "sipping."

However, including both a pour spout and sip spout on a drinking vessel lid has met obstacles given the limited surface area of a lid for including all of the components of such spouts. Additionally, simply including two spouts to dispense fluids differently presents one challenge, while providing them in a configuration that still permits easy access to the two spouts presents another challenge. Further, providing both functions could easily complicate the interior configuration of a lid to the extent that a drinking vessel does not drain the entire contents, given the complexity of including both spouts. Similarly, the complexity could easily inhibit cleaning of the lid internal components. Nevertheless, dual-dispensing lid 1 shown in FIGS. 1-6 provides both pour spout 8 and sip spout 14 in a configuration that provides easy access to both spouts, permits draining the entire contents of a drinking vessel including dual-dispensing lid 1, and still permits easy cleaning.

It follows that lid body 2 includes a fluid collection well 28 surrounding pour orifice 6 on an interior surface of top wall 22 of lid body 2. Fluid collection well 28 is defined partly by side wall 24 of lid body 2 and partly by the interior surface of top wall 22 so as to facilitate draining substantially all fluid within fluid container 4 through pour spout 8. When dual-dispensing lid 1 is in operation, those of ordinary skill will appreciate that tilting a drinking vessel with dual-dispensing lid 1 engaged thereon collects fluid within collection well 28. As the fluid level decreases, residual fluid channels into collection well 28 instead of into other portions of the interior of dual-dispensing lid 1 and thus allows draining the entire contents.

More specifically, fluid collection well 28 is further defined partly by a containment wall 30 extending from side wall 24 and from the interior surface of top wall 22 so as to facilitate further the draining of substantially all fluid within fluid container 4 through pout spout 8. Even further, top wall 22 of lid body 2 includes an upper elevation portion 32 and a lower elevation portion 36 at an elevational level lower than upper elevation portion 32. Pour orifice 6 extends through lower elevation portion 36 of top wall 22. Pour spout 8 corresponding with pour orifice 6 is recessed into top wall 22 compared to the immediately adjacent topography as provided by the elevational difference between upper elevation portion 32 and lower elevation portion 36.

The interior surface of top wall 22 from which containment wall 30 extends is an interior surface of lower elevation portion 36 of top wall 22. Because of the elevational level of lower elevation portion 36, some fluid would not drain though pour orifice 6 in the absence of collection well 28 when fluid vessel 4 is tilted for drinking. Accordingly, collection well 28 further facilitates draining substantially all fluid.

FIGS. 1-6 show various features of sip cap 16 in further detail. Sip cap 16 is rotationally mounted on top wall 22 of lid body 2 and, when released from compression against sip spout 14, is configured for movement along an arcuate path to an open position, shown in FIG. 3, to render sip spout 14 accessible for withdrawing from fluid container 4. The rotational mounting of sip cap 16 involves two cap arms 18 of sip cap 16 linked to top wall 22 by two cap pivots 20 inserted in two corresponding cap sockets 21 such that releasing sip cap 16 from compression against sip spout 14 permits rotating sip cap 16 about cap pivots 20. Swinging sip cap 16 toward pour cap 10 renders sip spout 14 accessible for withdrawing liquid from fluid container 4. The material properties of sip spout 14 may be selected so the resilience thereof is sufficient of itself to propel sip cap 16 away from sip spout 14 in the indicated swinging action.

As noted above, sip cap 16 is selectively compressible against sip spout 14 in a manner that seals sip spout 14. Such feature is provided by structure shown in FIGS. 1-6. Top wall 22 of lid body 2 includes an arcuate berm profile 38 having a slope 40 facing sip spout 14. Sip cap 16 includes an arcuate rim 42 configured to compress sip spout 14 between slope 40 and rim 42. The arcuate shape of berm profile 38 urges sip spout 14 into a position at the center of the arc in berm profile 38 when sip cap 16 compresses sip spout 14. The arcuate shape of rim 42 corresponds with the arcuate shape of berm profile 38, providing a gap between them wherein sip spout 14 may be compressed and sealed close.

Compression of sip cap 16 against sip spout 14 is partly enabled by a clasp linking sip cap 16 to lid body 2. The clasp in FIGS. 1-6 includes a lower clasp piece 44 engaged with lid body 2 and an upper clasp piece 46 formed as part of sip cap 16 or otherwise linked to sip cap 16. A spring 43 is mounted on a spring post 45 so as to bias lower clasp piece 44 in a locking position that engages upper clasp piece 46 when sip cap 16 is closed. Consequently, closing sip cap 16 engages clasp pieces 44, 46 and retains sip cap 16 in compression against sip spout 14. Release of upper clasp piece 46 from lower clasp piece 44 by compressing spring 43 permits the resilience of sip spout 14 to push sip cap 16 away from sip spout 14.

Opening sip cap 16 also enables venting while removing liquid through sip spout 14 and closing sip cap 16 disables such venting. The functioning structure is shown in FIGS. 1-6 by a vent orifice 48 through top wall 22 and a resilient vent plug 49 having a vent passage (not shown) through vent plug 49. Vent plug 49 is inserted through vent orifice 48 and registers in sealing association with vent orifice 48. A vent post 47 extends from an interior surface of sip cap 16 and is configured to contact vent plug 49 in sealing association with the vent passage when sip cap 16 compresses against sip spout 14 in a manner that seals sip spout 14. Consequently, closing sip cap 16 accomplishes two purposes of sealing both sip spout 14 and the vent passage.

A number of geometric configurations for sip spouts, pour spouts, and lid bodies are possible, but FIGS. 1-6 show selected configurations. Dual-dispensing lid 1 is shown with a portion of sip spout 14 extending outward from top wall 22 being non-linear along its longitudinal length. Also, pour spout 8 is shown as substantially cylindrical. More specifically, side wall 24 of lid body 2 is shown as circular in lateral cross-section. Pour spout 8 is shown as circular in the lateral cross-section. However, sip spout 14 extending outward from top wall 22 is shown as oval in lateral cross-section. The oval cross-section of sip spout 14 enables easier sealing by sip cap 16. Notably, sip spout 14 is shown with a different, circular cross-section for its internal portion configured to receive a straw, tube, or the like (not shown) to withdraw fluid within fluid container 4 when in an upright position.

Dual-dispensing lid 1 is shown in FIGS. 1-6 with additional convenience features. For example, a handle 3 is secured to lid body 2 by placing handle 3 over two posts 5 and securing thereto by means of two pins 7. Handle 3 provides easy carrying of a drinking vessel including dual-dispensing lid 1. Dual-dispensing lid 1 additionally includes a retainer 11 engaged both with pour cap 10 and pour spout 8 such that pour cap 10 is not easily lost when removed for drinking.

For improved clarity, some components of dual-dispensing lid 1 are removed from the cross-sectional view shown in FIG. 6. For example, spring 43 is not shown engaged on spring post 45. Also, sip spout 14 is not shown compressed between slope 40 and rim 42. Further, pour cap 10 and retainer 11 are not included to perceive more clearly the elevational differences between upper elevation portion 32 and lower elevation portion 36. A gasket (not shown for simplicity) normally would exist between lid body 2 and fluid container 4 to provide sealed engagement.

Figure 12:
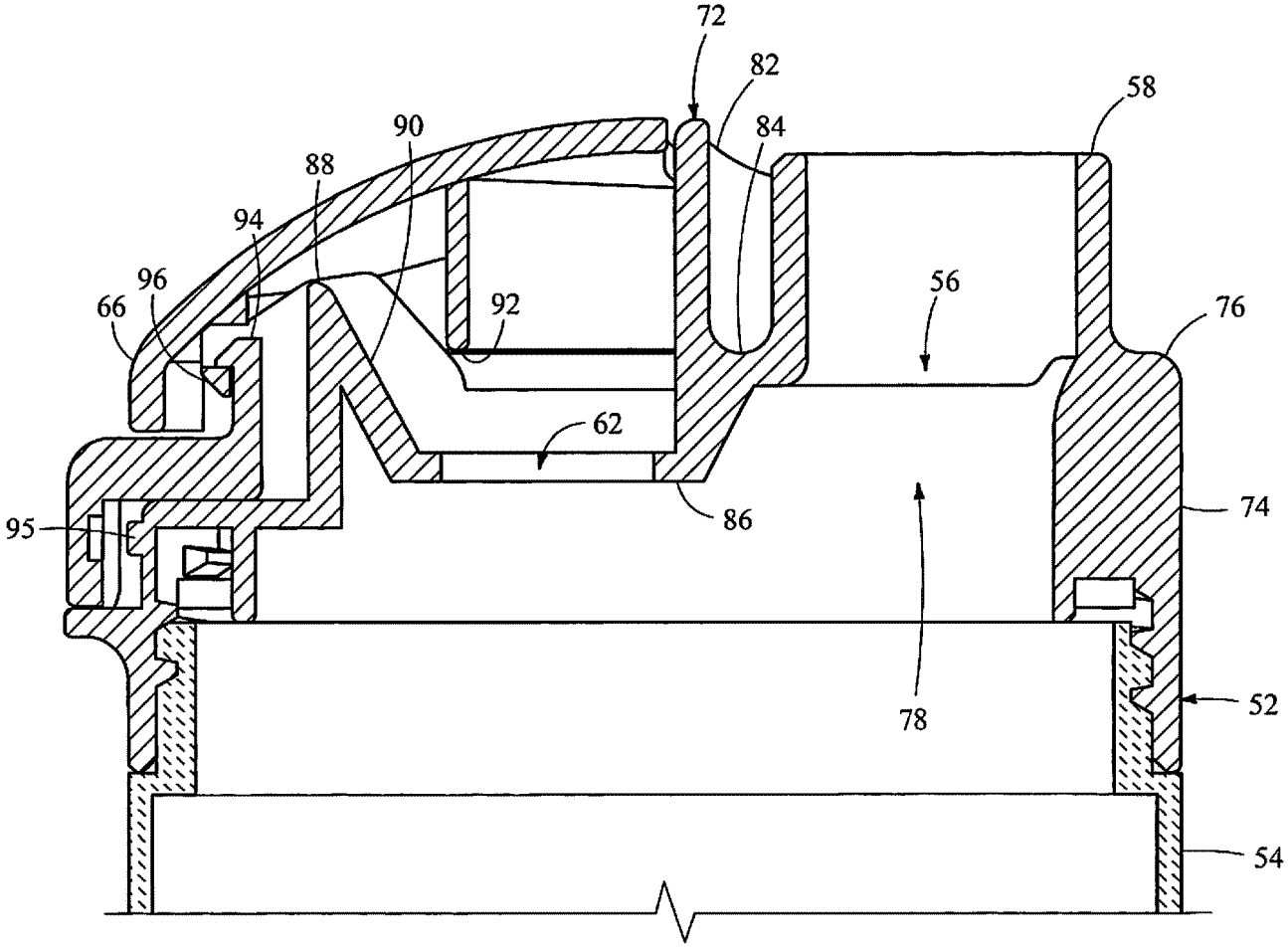
FIG. 12 is a cross-sectional view of the second dual-dispensing lid shown in FIGS. 7-11 engaged with a fluid container.

FIGS. 7-12 show a dual-dispensing lid 50 for use with a fluid container, such as fluid container 54 shown in FIG. 12. Fluid container 54 may have a wide variety of sizes and shapes and yet be operable in combination with dual-dispensing lid 50. Accordingly, the details of any particular fluid container 54 are not shown. In many respects, dual-dispensing lid 50 includes similar features to dual-dispensing lid 1 in FIGS. 1-6. As such, the descriptions above regarding the detailed specifics of features in common with dual-dispensing lid 1, as revealed by comparison of FIGS. 7-12 with respective FIGS. 1-6, also apply to dual-dispensing lid 50. However, some notable differences exist where expressly discussed below.

Dual-dispensing lid 50 includes a lid body 52 having a top wall 72 with a peripheral edge 76 and a circumscribing side wall 74 extending from peripheral edge 76. Lid body 52 is selectively detachable from fluid container 54 shown in FIG. 12. Lid body 52 is configured to engage side wall 74 with fluid container 54 in sealing association. FIG. 12 shows a threaded connection between lid body 52 and fluid container 54, but other configurations for engagement are conceivable.

Dual-dispensing lid 50 includes a pour orifice 56 through top wall 72. A pour spout 58 corresponds with pour orifice 56 and extends outward from top wall 72. A pour cap 60 is selectively detachable from direct contact with pour spout 58 and is configured to engage with pour spout 58 in manner that seals pour spout 58 from fluid exiting fluid container 54 through pour spout 58. FIGS. 7-12 show a compression connection between pour cap 60 and pour spout 58, but other configurations for engagement, such as threaded connections, are conceivable. Pour spout 58 is shown as being circular in its lateral cross-section, however, other geometries are conceivable.

Dual-dispensing lid 50 includes a sip orifice 62 through top wall 72. An elongated and resilient sip spout 64 is inserted through sip orifice 62, registers in sealing association with sip orifice 62, and extends outward from top wall 72. A sip cap 66 is selectively releasable from compression against sip spout 64 and is selectively compressible against sip spout 64 in a manner that seals sip spout 64 from fluid exiting fluid container 54 through sip spout 64.

As is apparent from FIGS. 7-12, sip spout 64 has a size configured to pass a sipped volumetric flow rate of fluid exiting fluid container 54. Pour spout 58 has a sized configured to pass a poured volumetric flow rate of fluid exiting fluid container 54. Given the size and configuration differences between sip spout 64 and pour spout 58 those of ordinary skill will appreciate that the poured volumetric flow rate is greater than the sipped volumetric flow rate.

The presence of spouts for dispensing fluid from a drinking vessel with two different flow rates increases the versatility of the drinking vessels described herein. Draining a drinking vessel quickly by "chugging" may be advantageous in certain circumstances, while users in other circumstances may prefer drinking more slowly by "sipping."

However, including both a pour spout and sip spout on a drinking vessel lid has met obstacles given the limited surface area of a lid for including all of the components of such spouts. Additionally, simply including two spouts to dispense fluids differently presents one challenge, while providing them in a configuration that still permits easy access to the two spouts presents another challenge. Further, providing both functions could easily complicate the interior configuration of a lid to the extent that a drinking vessel does not drain the entire contents, given the complexity of including both spouts. Similarly, the complexity could easily inhibit cleaning of the lid internal components. Nevertheless, dual-dispensing lid 50 shown in FIGS. 7-12 provides both pour spout 58 and sip spout 64 in a configuration that provides easy access to both spouts, permits draining the entire contents of a drinking vessel including dual-dispensing lid 50, and still permits easy cleaning.

It follows that lid body 52 includes a fluid collection well 78 surrounding pour orifice 56 on an interior surface of top wall 72 of lid body 52. Fluid collection well 78 is defined partly by side wall 74 of lid body 52 and partly by the interior surface of top wall 72 so as to facilitate draining substantially all fluid within fluid container 54 through pour spout 58. When dual-dispensing lid 50 is in operation, those of ordinary skill will appreciate that tilting a drinking vessel with dual-dispensing lid 50 engaged thereon collects fluid within collection well 78. As the fluid level decreases, residual fluid channels into collection well 78 instead of into other portions of the interior of dual-dispensing lid 50 and thus allows draining the entire contents.

In FIGS. 7-12, top wall 72 of lid body 52 further includes an upper elevation portion 82, a middle elevation portion 84 at an elevational level lower than upper elevation portion 82, and a lower elevation portion 86 at an elevational level lower than middle elevation portion 84. Pour orifice 56 extends through middle elevation portion 84 of top wall 72. Pour spout 58 corresponds with pour orifice 56 and is recessed into top wall 72 compared to the immediately adjacent topography as provided by the elevational difference between upper elevation portion 82 and middle elevation portion 84. Sip orifice 62 extends through lower elevation portion 86 of top wall 72.

Figure 9:
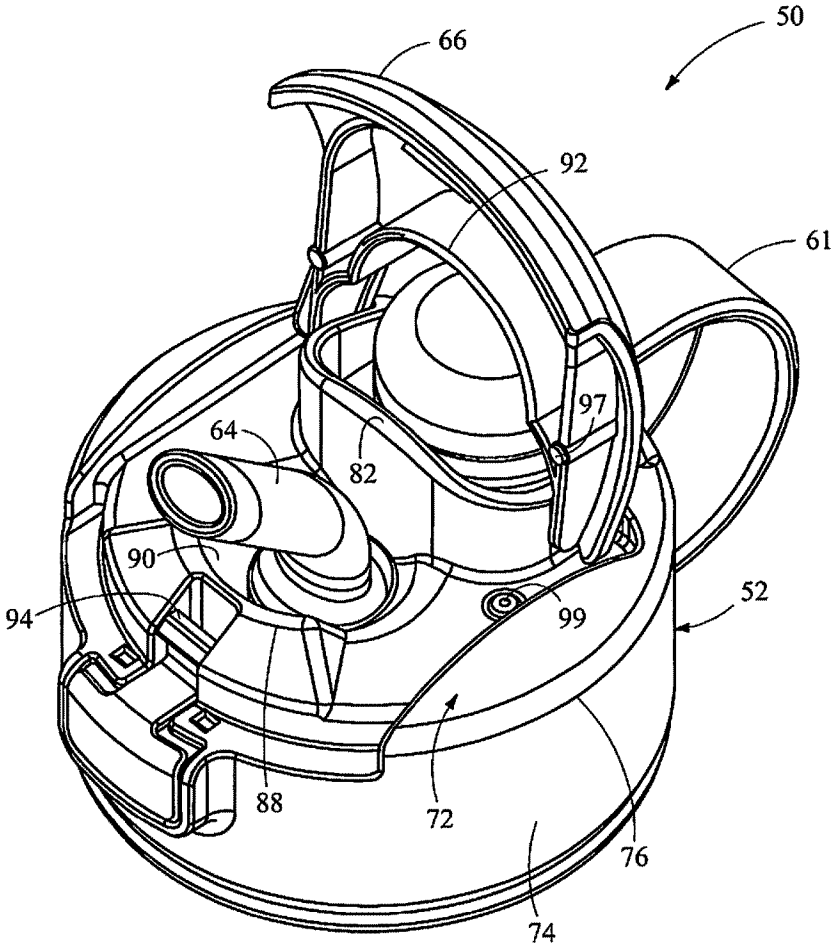
Figure 10:
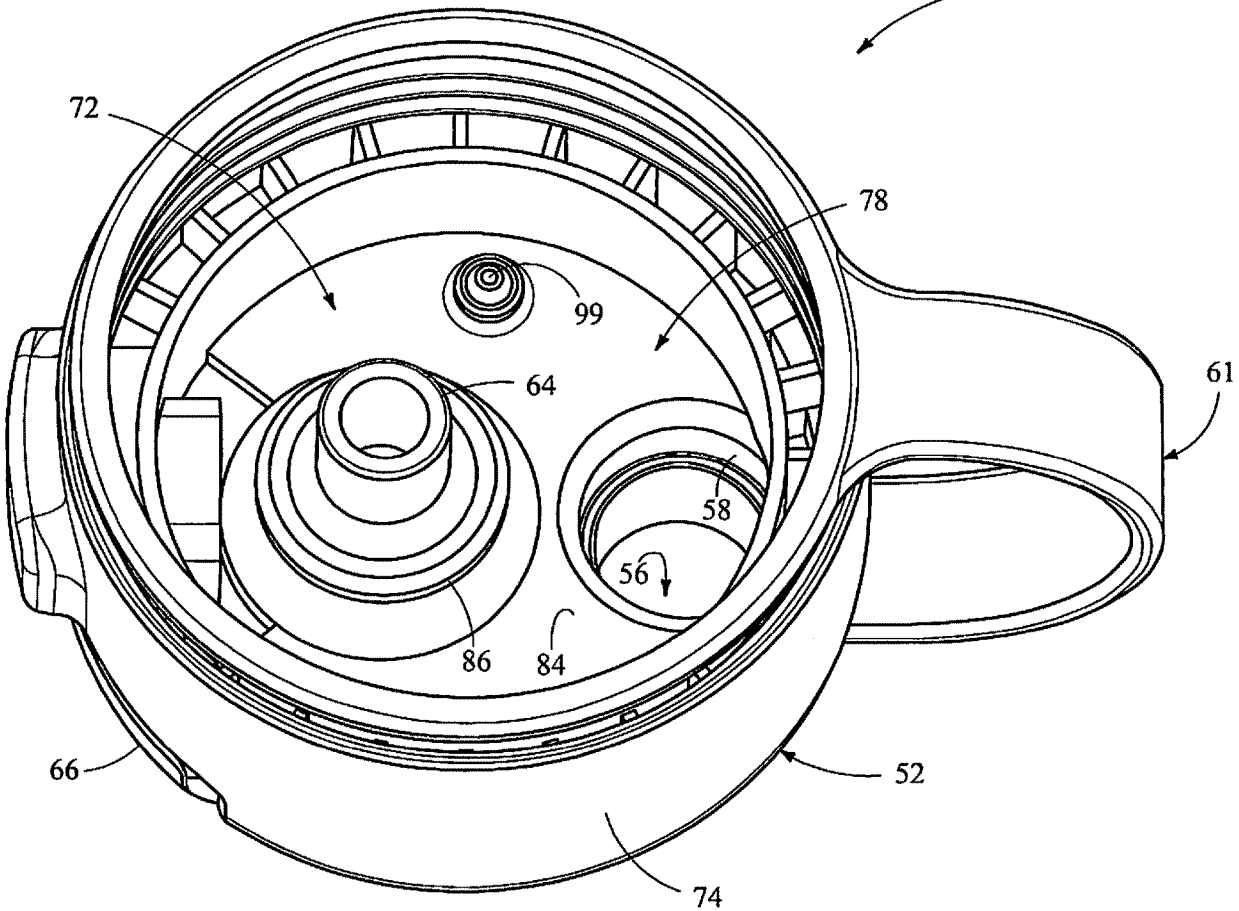
Figure 11:
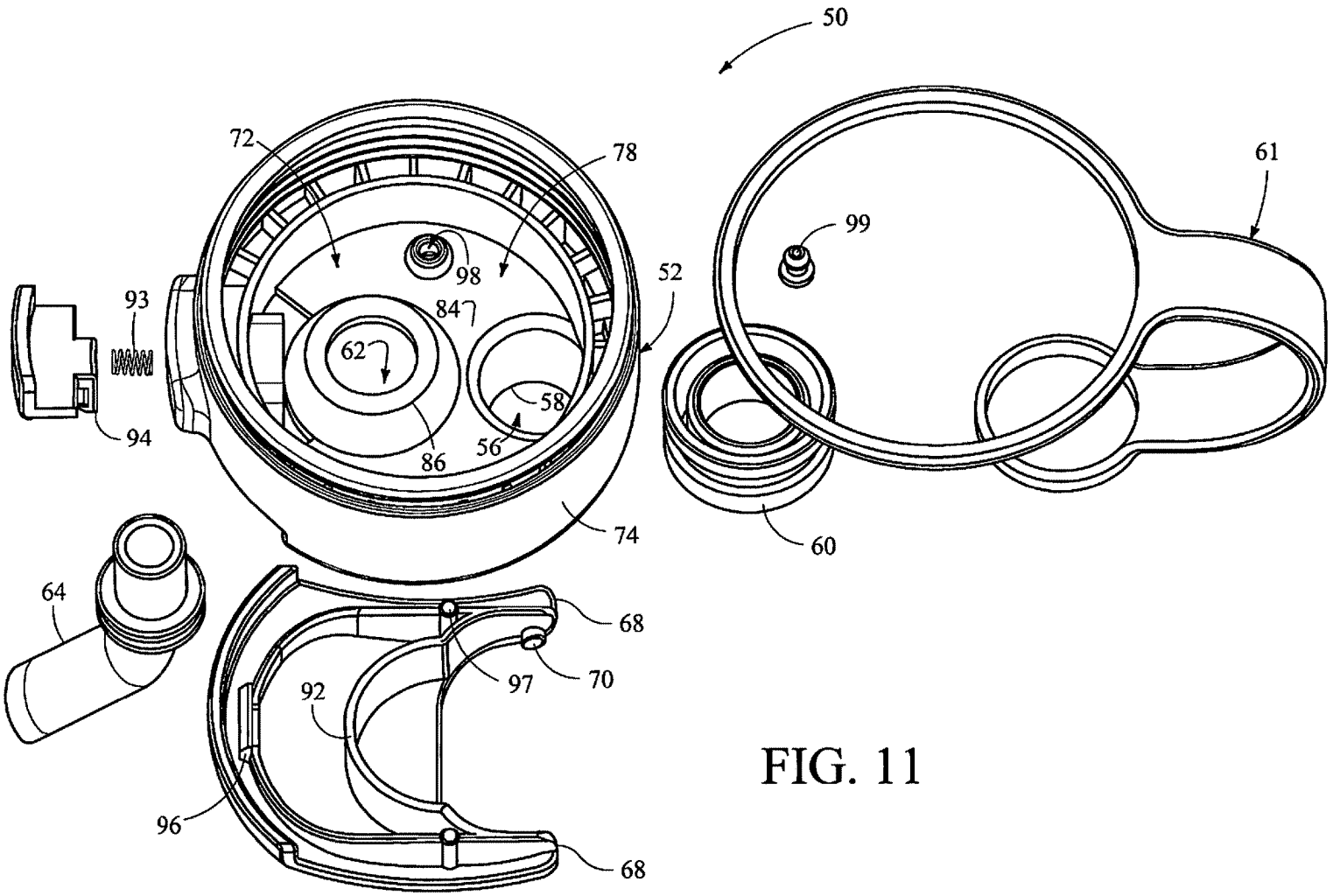

FIGS. 7-12 further show various features of sip cap 66 in further detail. Sip cap 66 is rotationally mounted on top wall 72 of lid body 52 and, when released from compression against sip spout 64 is configured for movement along an arcuate path to an open position to render sip spout 64 accessible for withdrawing fluid from container 54. The open position is shown in FIG. 9. The rotational mounting of sip cap 66 includes two cap arms 68 of sip cap 66 linked to top wall 72 by two cap pivots 70 positioned at opposing sides of pour spout 58 and inserted in two corresponding cap sockets 71. Releasing sip cap 66 from compression against sip spout 64 permits rotating sip cap 66 about cap pivots 70 and swinging an entirety of sip cap 66, except for cap arms 68, above pour cap 60 and renders sip spout 64 accessible for withdrawing fluid from container 54. The material properties of sip spout 64 may be selected so the resilience thereof is sufficient of itself to propel sip cap 66 away from sip spout 64 in the indicated swinging action.

Dual-dispensing lid 50 selectively compresses sip cap 66 against sip spout 64 in a manner that seals sip spout 64. The sealing of sip spout 64 is provided by top wall 72 of lid body 52 further including a berm profile 88 having a slope 90 facing sip spout 64. Sip cap 66 further includes an arcuate rim 92 configured to compress sip spout 64 between slope 90 and rim 92. The arcuate shape of berm profile 88 urges sip spout 64 into a position at the center of the arc in berm profile 88 when sip cap 66 compresses sip spout 64. The arcuate shape of rim 92 corresponds with the arcuate shape of berm profile 88, providing a gap between them wherein sip spout 64 may be compressed and sealed close.

Compression of sip cap 66 against sip spout 64 is partly enabled by a clasp linking sip cap 66 to lid body 52. The clasp in FIGS. 7-12 includes a lower clasp piece 94 engaged with lid body 52 and an upper clasp piece 96 formed as part of sip cap 66 or otherwise linked to sip cap 66. A spring 93 is mounted on a spring post 95 so as to bias lower clasp piece 94 in a locking position that engages upper clasp piece 96 when sip cap 66 is closed. Consequently, closing sip cap 66 engages clasp pieces 94, 96 and retains sip cap 66 in compression against sip spout 64. Release of upper clasp piece 96 from lower clasp piece 94 by compressing spring 93 permits the resilience of sip spout 64 to push sip cap 66 away from sip spout 64.

Opening sip cap 66 also enables venting while removing liquid through sip spout 64 and closing sip cap 66 disables such venting. Dual-dispensing lid 50 includes a vent orifice 98 through top wall 72 and a resilient vent plug 99 having a vent passage (not shown) through vent plug 99. Vent plug 99 is inserted through vent orifice 98 and registers in sealing association with vent orifice 98. A vent post 97 extends from an interior surface of sip cap 66 and is configured to contact vent plug 99 in sealing association with the vent passage when sip cap 66 compresses sip spout 64 in a manner that seals sip spout 64. Consequently, closing sip cap 66 accomplishes two purposes of sealing both sip spout 64 and the vent passage.

A variety of geometric configurations are possible for sip spouts, pour spouts, and lid bodies, but FIGS. 7-12 show selected configurations. A portion of sip spout 64 extends outward from top wall 72 and is non-linear along its longitudinal length. Pour spout 58 is shown as substantially cylindrical. Also, side wall 74 of lid body 52 is circular in lateral cross-section. Pour spout 58 is circular in lateral cross-section. Sip spout 64 extends outward from the top wall and is oval in lateral cross-section. The oval cross-section of sip spout 64 enables easier sealing by sip cap 66. Notably, sip spout 64 is shown with a different, circular cross-section for its internal portion configured to receive a straw, tube, or the like (not shown) to withdraw fluid within fluid container 54 when in an upright position.

Dual-dispensing lid 50 is shown in FIGS. 7-12 with additional convenience features. For example, dual-dispensing lid 50 additionally includes a retainer 61 engaged both with pour cap 60 and pour spout 58 such that pour cap 60 is not easily lost when removed for drinking.

For improved clarity, some components of dual-dispensing lid 50 are removed from the cross-sectional view shown in FIG. 12. For example, spring 93 is not shown engaged on spring post 95. Also, sip spout 64 is not shown compressed between slope 90 and rim 92. Further, pour cap 60 and retainer 61 are not included to perceive more clearly the elevational differences between upper elevation portion 82 and lower elevation portion 86. A gasket (not shown for simplicity) normally would exist between lid body 52 and fluid container 54 to provide sealed engagement.

According to one device, a dual-dispensing lid for use with a fluid container includes a lid body having a top wall with a peripheral edge and a circumscribing side wall extending from the peripheral edge. The lid body is selectively detachable from the fluid container and configured to engage the side wall with the fluid container in sealing association.

The lid includes a pour orifice through the top wall, a pour spout corresponding with the pour orifice and extending outward from the top wall, and a pour cap selectively detachable from direct contact with the pour spout. The pour cap is configured to engage with the pour spout in a manner that seals the pour spout from fluid exiting the fluid container through the pour spout.

The lid also includes a sip orifice through the top wall and an elongated and resilient sip spout inserted through the sip orifice, registered in sealing association with the sip orifice, and extending outward from the top wall. A sip cap is selectively releasable from compression against the sip spout and selectively compressible against the sip spout in a manner that seals the sip spout from fluid exiting the fluid container through the sip spout.

Additional features may be implemented in the present device/method. By way of example, the sip spout may have a size configured to pass a sipped volumetric flow rate of fluid exiting the fluid container. The pour spout may have a size configured to pass a poured volumetric flow rate of fluid exiting the fluid container that is greater than the sipped volumetric flow rate.

The lid body may further include a fluid collection well surrounding the pour orifice on an interior surface of the top wall of the lid body, the fluid collection well being defined partly by the side wall of the lid body and partly by the interior surface of the top wall so as to facilitate draining substantially all fluid within the fluid container through the pour spout.

The top wall of the lid body may further include an upper elevation portion, a middle elevation portion at an elevational level lower than the upper elevation portion, and a lower elevation portion at an elevational level lower than the middle elevation portion. The pour orifice extends through the middle elevation portion of the top wall. The pour spout corresponding with the pour orifice is recessed into the top wall compared to the immediately adjacent topography as provided by the elevational difference between the upper elevation portion and the middle elevation portion. The sip orifice extends through the lower elevation portion of the top wall.

Alternatively, the fluid collection well may be further defined partly by a containment wall extending from the side wall and from the interior surface of the top wall so as to further facilitate draining substantially all fluid within the fluid container through the pour spout. If the containment wall is present, the top wall of the lid body could include an upper elevation portion and a lower elevation portion at an elevational level lower than the upper elevation portion. The pour orifice may extend through the lower elevation portion of the top wall. The pour spout corresponding with the pour orifice is recessed into the top wall compared to the immediately adjacent topography as provided by the elevational difference between the upper elevation portion and the lower elevation portion. The interior surface of the top wall from which the containment wall extends is an interior surface of the lower elevation portion of the top wall.

The sip cap may be rotationally mounted on the top wall of the lid body and, when released from compression against the sip spout, may be configured for movement along an arcuate path to an open position to render the sip spout accessible for withdrawing fluid from the container. Further, the rotational mounting of the sip cap could include two arms of the sip cap linked to the top wall by pivots positioned at opposing sides of the pour spout such that releasing the sip cap from compression against the sip spout permits rotating the sip cap about the pivots. An entirety of the sip cap, except for the cap arms, could swing above the pour cap and render the sip spout accessible for withdrawing fluid from the container.

The selective compressibility of the sip cap against the sip spout in a manner that seals the sip spout may be provided by the top wall and the sip cap. The top wall of the lid body may include a berm profile having a slope facing the sip spout. The sip cap may include an arcuate rim configured to compress the sip spout between the slope and the rim.

The dual-dispensing lid may further include a clasp linking the sip cap to the lid body and retaining the sip cap in compression against the sip spout, release of the clasp permitting the resilience of the sip spout to push the sip cap away from the sip spout.

The dual-dispensing lid may further include a vent orifice through the top wall, a resilient vent plug having a vent passage through the vent plug, and a vent post extending from an interior surface of the sip cap. The vent plug is inserted through the vent orifice and registered in sealing association with the vent orifice. The vent post is configured to contact the vent plug in sealing association with the vent passage when the sip cap compresses against the sip spout in a manner that seals the sip spout.

A portion of the sip spout extending outward from the top wall may be non-linear along its longitudinal length and the pour spout may be substantially cylindrical. The side wall of the lid body may be circular in lateral cross-section, the pour spout may be circular in lateral cross-section, and the sip spout extending outward from the top wall may be oval in lateral cross-section.

The additional features that may be implemented in the present device may also be implemented in other devices herein.

In another device, a dual-dispensing lid for use with a fluid container includes a lid body having a top wall with a peripheral edge and a circumscribing side wall extending from the peripheral edge. The lid body is selectively detachable from the fluid container and configured to engage the side wall with the fluid container in sealing association. The lid has an upper elevation portion and a lower elevation portion of the top wall of the lid body, the lower elevation portion being at an elevational level lower than the upper elevation portion.

A pour orifice exists through the lower elevation portion of the top wall and a pour spout corresponds with the pour orifice. The pour orifice extends outward from the top wall, recesses into the top wall compared to the immediately adjacent topography as provided by the elevational difference between the upper elevation portion and the lower elevation portion, and has a size configured to pass a poured volumetric flow rate of fluid exiting the fluid container. A pour cap selectively detaches from direct contact with the pour spout and is configured to engage with the pour spout in a manner that seals the pour spout from fluid exiting the fluid container through the pour spout.

A sip orifice exists through the top wall. An elongated and resilient sip spout inserts through the sip orifice, registers in sealing association with the sip orifice, extends outward from the top wall, and has a size configured to pass a sipped volumetric flow rate of fluid exiting the fluid container that is less than the poured volumetric flow rate. A sip cap selectively releases from compression against the sip spout and selectively compresses against the sip spout in a manner that seals the sip spout from fluid exiting the fluid container through the sip spout.

A fluid collection well surrounds the pour orifice on an interior surface of the lower elevation portion of the top wall of the lid body. The fluid collection well is defined partly by the side wall of the lid body, partly by the interior surface of the lower elevation portion of the top wall, and partly by a containment wall extending from the side wall and from the interior surface of the lower elevation portion of the top wall. The fluid collection well facilitates draining substantially all fluid within the fluid container through the pour spout.

Additional features may be implemented in the present device. By way of example, the sip cap is rotationally mounted on the top wall of the lid body. When released from compression against the sip spout, the sip cap is configured for movement along an arcuate path to an open position to render the sip spout accessible for withdrawing fluid from the container. The selective compressibility of the sip cap against the sip spout in a manner that seals the sip spout may be provided by the top wall and the sip cap: The top wall of the lid body may include a berm profile having an inward facing slope at an elevational level above the immediately surrounding topography. The sip cap may include an arcuate rim configured to compress the sip spout between the slope and the arcuate rim.

The dual-dispensing lid may further include a vent orifice through the top wall. A resilient vent plug having a vent passage is through the vent plug, the vent plug being inserted through the vent orifice and registered in sealing association with the vent orifice. A vent post extends from an interior surface of the sip cap and is configured to contact the vent plug in sealing association with the vent passage when the sip cap compresses against the sip spout in a manner that seals the sip spout.

The additional features that may be implemented in the present device may also be implemented in other embodiments herein.

In a further device, a dual-dispensing lid for use with a fluid container includes a lid body having a top wall with a peripheral edge and a circumscribing side wall extending from the peripheral edge. The lid body selectively detaches from the fluid container and is configured to engage the side wall with the fluid container in sealing association.

A pour orifice exists through the top wall. A pour spout corresponds with the pour orifice, extending outward from the top wall, and having a size configured to pass a poured volumetric flow rate of fluid exiting the fluid container. A pour cap selectively detaches from direct contact with the pour spout and is configured to engage with the pour spout in a manner that seals the pour spout from fluid exiting the fluid container through the pour spout.

A sip orifice exists through the top wall. An elongated and resilient sip spout inserts through the sip orifice, registers in sealing association with the sip orifice, extends outward from the top wall, and has a size configured to pass a sipped volumetric flow rate of fluid exiting the fluid container that is less than the poured volumetric flow rate. A sip cap selectively releases from compression against the sip spout and selectively compresses against the sip spout in a manner that seals the sip spout from fluid exiting the fluid container through the sip spout. The sip cap is rotationally mounted on the top wall of the lid body by two arms of the sip cap linked to the top wall by pivots positioned at opposing sides of the pour spout. Releasing the sip cap from compression against the sip spout permits rotating the sip cap about the pivots along an arcuate path and swinging an entirety of the sip cap, except for the cap arms, to an open position above the pour cap. The open position renders the sip spout accessible for withdrawing fluid from the container.

Additional features may be implemented in the present device. By way of example, the selective compressibility of the sip cap against the sip spout in a manner that seals the sip spout may be provided by the top wall and the sip cap. The top wall of the lid body may further include a berm profile having a slope facing the sip spout. The sip cap may further include an arcuate rim configured to compress the sip spout between the slope and the rim.

The dual-dispensing lid may further include a vent orifice through the top wall, a resilient vent plug having a vent passage through the vent plug, and a vent post extending from an interior surface of the sip cap. The vent plug is inserted through the vent orifice and registers in sealing association with the vent orifice. The vent post extends from an interior surface of the sip cap and is configured to contact the vent plug in sealing association with the vent passage when the sip cap compresses against the sip spout in a manner that seals the sip spout.

The additional features that may be implemented in the present device/method may also be implemented in other embodiments herein.

The inventors expressly contemplate that the various options described herein for individual apparatuses are not intended to be so limited except where incompatible. The features and benefits of individual apparatuses herein may be used in combination with other apparatuses described herein even though not specifically indicated elsewhere.

In compliance with the statute, the embodiments have been described in language more or less specific as to structural features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

TABLE OF REFERENCE NUMERALS FOR FIGURES

| | |
|---|---|
| 1 dual-dispensing lid | 50 dual-dispensing lid |
| 2 lid body | 52 lid body |
| 3 handle | 54 fluid container |
| 4 fluid container | 56 pour orifice |
| 5 post | 58 pour spout |
| 6 pour orifice | 60 pour cap |
| 7 pin | 61 retainer |
| 8 pour spout | 62 sip orifice |
| 10 pour cap | 64 sip spout |
| 11 retainer | 66 sip cap |
| 12 sip orifice | 68 cap arm |
| 14 sip spout | 70 cap pivot |
| 16 sip cap | 71 cap socket |
| 18 cap arm | 72 top wall |
| 20 cap pivot | 74 side wall |
| 21 cap socket | 76 peripheral edge |
| 22 top wall | 78 collection well |
| 24 side wall | 82 upper elevation portion |
| 26 peripheral edge | 84 middle elevation portion |
| 28 collection well | 86 lower elevation portion |
| 30 containment wall | 88 berm profile |
| 32 upper elevation portion | 90 slope |
| 36 lower elevation portion | 92 rim |
| 38 berm profile | 93 spring |
| 40 slope | 94 lower clasp piece |
| 42 rim | 95 spring post |
| 43 spring | 96 upper clasp piece |
| 44 lower clasp piece | 97 vent post |
| 45 spring post | 98 vent orifice |
| 46 upper clasp piece | 99 vent plug |
| 47 vent post | |
| 48 vent orifice | |
| 49 vent plug | |

What is claimed is:

1. A dual-dispensing lid for use with a fluid container comprising:

a lid body having a top wall with a peripheral edge and a circumscribing side wall extending from the peripheral edge, the lid body being selectively detachable from the fluid container and configured to engage the side wall with the fluid container in sealing association;

a pour orifice through the top wall;

a pour spout corresponding with the pour orifice and extending outward from the top wall;

a pour cap selectively detachable from direct contact with the pour spout and configured to engage with the pour spout in a manner that seals the pour spout from fluid exiting the fluid container through the pour spout;

a sip orifice through the top wall;

an elongated and resilient sip spout inserted through the sip orifice, registered in sealing association with the sip orifice, and extending outward from the top wall;

a sip cap selectively releasable from compression against the sip spout and selectively compressible against the sip spout in a manner that seals the sip spout from fluid exiting the fluid container through the sip spout;

a vent orifice through the top wall;

a resilient vent plug having a vent passage through the vent plug, the vent plug being inserted through the vent orifice and registered in sealing association with the vent orifice; and a vent post extending from an interior surface of the sip cap and configured to contact the vent plug in sealing association with the vent passage when the sip cap compresses against the sip spout in a manner that seals the sip spout.

2. The dual-dispensing lid of claim 1, wherein the sip spout has a size configured to pass a sipped volumetric flow rate of fluid exiting the fluid container and the pour spout has a size configured to pass a poured volumetric flow rate of fluid exiting the fluid container that is greater than the sipped volumetric flow rate.

3. The dual-dispensing lid of claim 1, wherein the lid body further comprises a fluid collection well surrounding the pour orifice on an interior surface of the top wall of the lid body, the fluid collection well being defined partly by the side wall of the lid body and partly by the interior surface of the top wall so as to facilitate draining substantially all fluid within the fluid container through the pour spout.

4. The dual-dispensing lid of claim 3, wherein:

the top wall of the lid body further comprises an upper elevation portion, a middle elevation portion at an elevational level lower than the upper elevation portion, and a lower elevation portion at an elevational level lower than the middle elevation portion;

the pour orifice extends through the middle elevation portion of the top wall;

the pour spout corresponding with the pour orifice is recessed into the top wall compared to the immediately adjacent topography as provided by the elevational difference between the upper elevation portion and the middle elevation portion; and the sip orifice extends through the lower elevation portion of the top wall.

5. The dual-dispensing lid of claim 3, wherein the fluid collection well is further defined partly by a containment wall extending from the side wall and from the interior surface of the top wall so as to further facilitate draining substantially all fluid within the fluid container through the pour spout.

6. The dual-dispensing lid of claim 5, wherein:

the top wall of the lid body comprises an upper elevation portion and a lower elevation portion at an elevational level lower than the upper elevation portion;

the pour orifice extends through the lower elevation portion of the top wall;

the pour spout corresponding with the pour orifice is recessed into the top wall compared to the immediately adjacent topography as provided by the elevational difference between the upper elevation portion and the lower elevation portion; and the interior surface of the top wall from which the containment wall extends is an interior surface of the lower elevation portion of the top wall.

7. The dual-dispensing lid of claim 1, wherein the sip cap is rotationally mounted on the top wall of the lid body and, when released from compression against the sip spout, is configured for movement along an arcuate path to an open position to render the sip spout accessible for withdrawing fluid from the container.

8. The dual-dispensing lid of claim 7, wherein the rotational mounting of the sip cap comprises two arms of the sip cap linked to the top wall by pivots positioned at opposing sides of the pour spout such that releasing the sip cap from compression against the sip spout permits rotating the sip cap about the pivots and swinging an entirety of the sip cap, except for the cap arms, above the pour cap and renders the sip spout accessible for withdrawing fluid from the container.

9. The dual-dispensing lid of claim 1, wherein the selective compressibility of the sip cap against the sip spout in a manner that seals the sip spout is provided by:

the top wall of the lid body further comprising a berm profile having a slope facing the sip spout; and the sip cap further comprising an arcuate rim configured to compress the sip spout between the slope and the rim.

10. The dual-dispensing lid of claim 1 further comprising a clasp linking the sip cap to the lid body and retaining the sip cap in compression against the sip spout, release of the clasp permitting the resilience of the sip spout to push the sip cap away from the sip spout.

11. The dual-dispensing lid of claim 1, wherein the pour cap and the sip cap are capable of being closed at the same time.

12. The dual-dispensing lid of claim 1, wherein a portion of the sip spout extending outward from the top wall is non-linear along its longitudinal length and the pour spout is substantially cylindrical.

13. The dual-dispensing lid of claim 1, wherein the side wall of the lid body is circular in lateral cross-section, the pour spout is circular in lateral cross-section, and the sip spout extending outward from the top wall is oval in lateral cross-section.

14. A dual-dispensing lid for use with a fluid container comprising:

a lid body having a top wall with a peripheral edge and a circumscribing side wall extending from the peripheral edge, the lid body being selectively detachable from the fluid container and configured to engage the side wall with the fluid container in sealing association;

an upper elevation portion and a lower elevation portion of the top wall of the lid body, the lower elevation portion being at an elevational level lower than the upper elevation portion;

a pour orifice through the lower elevation portion of the top wall;

a pour spout corresponding with the pour orifice, extending outward from the top wall, recessed into the top wall compared to the immediately adjacent topography as provided by the elevational difference between the upper elevation portion and the lower elevation portion, and having a size configured to pass a poured volumetric flow rate of fluid exiting the fluid container;

a pour cap selectively detachable from direct contact with the pour spout and configured to engage with the pour spout in a manner that seals the pour spout from fluid exiting the fluid container through the pour spout;

a sip orifice through the top wall;

an elongated and resilient sip spout inserted through the sip orifice, registered in sealing association with the sip orifice, extending outward from the top wall, and having a size configured to pass a sipped volumetric flow rate of fluid exiting the fluid container that is less than the poured volumetric flow rate;

a sip cap selectively releasable from compression against the sip spout and selectively compressible against the sip spout in a manner that seals the sip spout from fluid exiting the fluid container through the sip spout; and a fluid collection well surrounding the pour orifice on an interior surface of the lower elevation portion of the top wall of the lid body, the fluid collection well being defined partly by the side wall of the lid body, partly by the interior surface of the lower elevation portion of the top wall, and partly by a containment wall extending from two separated positions on the side wall and from the interior surface of the lower elevation portion of the top wall such that the side wall partly defining the fluid collection well extends between the two separated positions so as to facilitate draining substantially all fluid within the fluid container through the pour spout.

15. The dual-dispensing lid of claim 14, wherein the sip cap is rotationally mounted on the top wall of the lid body and, when released from compression against the sip spout, is configured for movement along an arcuate path to an open position to render the sip spout accessible for withdrawing fluid from the container.

16. The dual-dispensing lid of claim 14, wherein the selective compressibility of the sip cap against the sip spout in a manner that seals the sip spout is provided by:

the top wall of the lid body further comprising a berm profile having an inward facing slope at an elevational level above the immediately surrounding topography; and the sip cap further comprising an arcuate rim configured to compress the sip spout between the slope and the arcuate rim.

17. The dual-dispensing lid of claim 14, further comprising:

a vent orifice through the top wall;

a resilient vent plug having a vent passage through the vent plug, the vent plug being inserted through the vent orifice and registered in sealing association with the vent orifice;

a vent post extending from an interior surface of the sip cap and configured to contact the vent plug in sealing association with the vent passage when the sip cap compresses against the sip spout in a manner that seals the sip spout.

18. A dual-dispensing lid for use with a fluid container comprising:

a lid body having a top wall with a peripheral edge and a circumscribing side wall extending from the peripheral edge, the lid body being selectively detachable from the fluid container and configured to engage the side wall with the fluid container in sealing association;

a pour orifice through the top wall;

a pour spout corresponding with the pour orifice, extending outward from the top wall, and having a size configured to pass a poured volumetric flow rate of fluid exiting the fluid container;

a pour cap selectively detachable from direct contact with the pour spout and configured to engage with the pour spout in a manner that seals the pour spout from fluid exiting the fluid container through the pour spout;

a sip orifice through the top wall;

an elongated and resilient sip spout inserted through the sip orifice, registered in sealing association with the sip orifice, extending outward from the top wall, and having a size configured to pass a sipped volumetric flow rate of fluid exiting the fluid container that is less than the poured volumetric flow rate; and a sip cap selectively releasable from compression against the sip spout and selectively compressible against the sip spout in a manner that seals the sip spout from fluid exiting the fluid container through the sip spout, the sip cap being rotationally mounted on the top wall of the lid body by two arms of the sip cap linked to the top wall by pivots positioned at opposing sides of the pour spout with the pour spout between the pivots such that releasing the sip cap from compression against the sip spout permits rotating the sip cap about the pivots along an arcuate path and swinging an entirety of the sip cap, except for the cap arms, to an open position above the pour cap and renders the sip spout accessible for withdrawing fluid from the container.

19. The dual-dispensing lid of claim 18, wherein the selective compressibility of the sip cap against the sip spout in a manner that seals the sip spout is provided by:

the top wall of the lid body further comprising a berm profile having a slope facing the sip spout; and the sip cap further comprising an arcuate rim configured to compress the sip spout between the slope and the rim.

20. The dual-dispensing lid of claim 18 further comprising:

a vent orifice through the top wall;

a resilient vent plug having a vent passage through the vent plug, the vent plug being inserted through the vent orifice and registered in sealing association with the vent orifice;

a vent post extending from an interior surface of the sip cap and configured to contact the vent plug in sealing association with the vent passage when the sip cap compresses against the sip spout in a manner that seals the sip spout.

21. The dual-dispensing lid of claim 14, wherein the pour cap and the sip cap are capable of being closed at the same time.

22. The dual-dispensing lid of claim 14, wherein the containment wall comprises a first wall and a second wall, each extending from a respective one of the two separated positions on the side wall and each being oriented along a respective principal direction parallel to the principal direction of the other, and a third wall oriented along a principal direction normal to the parallel, principal directions of the first and second walls.

23. The dual-dispensing lid of claim 18, wherein the pour cap and the sip cap are capable of being closed at the same time.

* * * * *